United States Patent [19]

Schmidt

[11] Patent Number: 4,982,894

[45] Date of Patent: Jan. 8, 1991

[54] MAILER WITH I.D. CARD AND METHOD

[75] Inventor: Eric Schmidt, Elgin, Ill.

[73] Assignee: Wallace Computer Services, Inc., Hillside, Ill.

[21] Appl. No.: 415,877

[22] Filed: Oct. 2, 1989

[51] Int. Cl.[5] ..... B65D 27/10

[52] U.S. Cl. ..... 229/69; 283/75; 283/101

[58] Field of Search ..... 282/28 A; 283/75, 101, 283/25; 229/69

[56] References Cited

U.S. PATENT DOCUMENTS

| | | | |
|---|---|---|---|
| 3,069,793 | 12/1962 | Francescon | 283/101 |
| 3,273,785 | 9/1966 | Beckman et al. | 229/69 |
| 3,319,872 | 5/1967 | Beckman et al. | 229/69 |
| 3,664,910 | 5/1972 | Hollie | 283/101 |
| 4,095,695 | 6/1978 | Steidinger | 229/69 |
| 4,159,586 | 7/1979 | Blum | 283/101 |
| 4,248,919 | 2/1981 | Davis | 282/28 A |
| 4,892,335 | 1/1990 | Taft | 283/75 |

*Primary Examiner*—Stephen P. Garbe

*Attorney, Agent, or Firm*—Tilton, Fallon, Lungmus & Chestnut

[57] ABSTRACT

A mailer I.D. product and method wherein each stuffed sealed envelope assembly is equipped with an insert ply having longitudinal and transverse lines of perforation defining an I.D. card, a pressure sensitive-equipped transparent film having a first portion attached to the insert ply and a second portion of the film being held in face-to-face relation within the envelope, the second portion of the film being equipped with a release liner.

11 Claims, 2 Drawing Sheets

FIG. 1
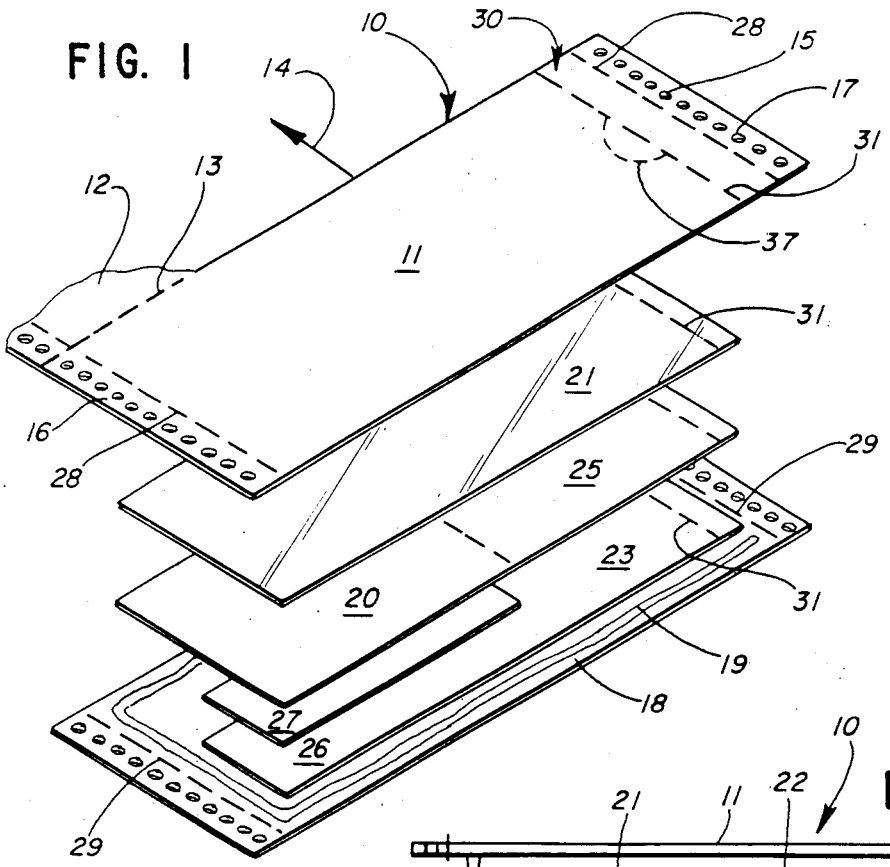
FIG. 2
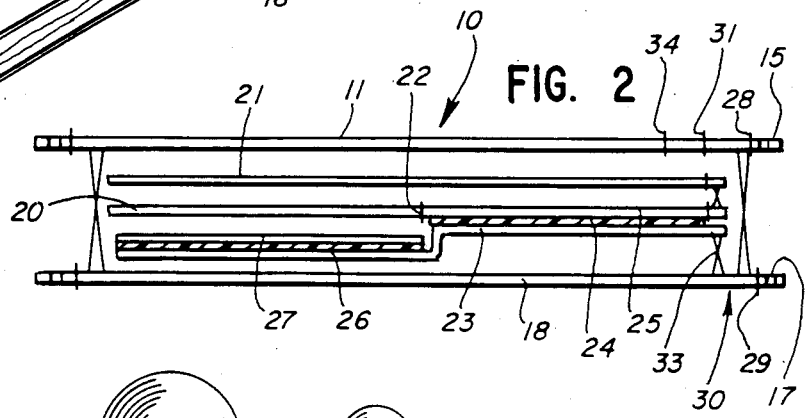
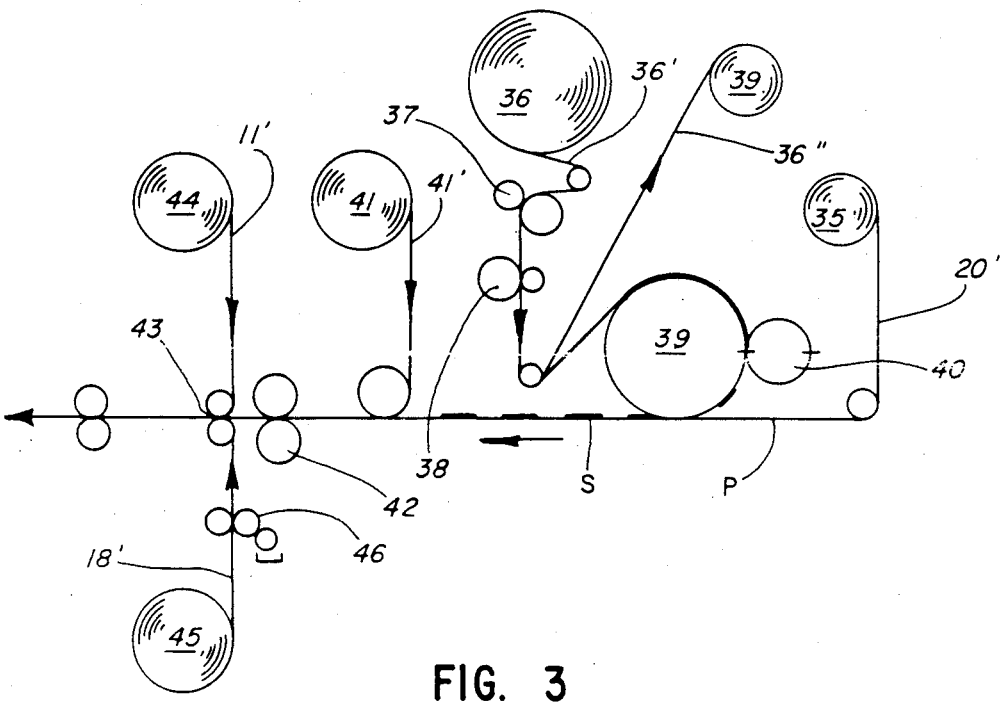
FIG. 3

FIG. 4
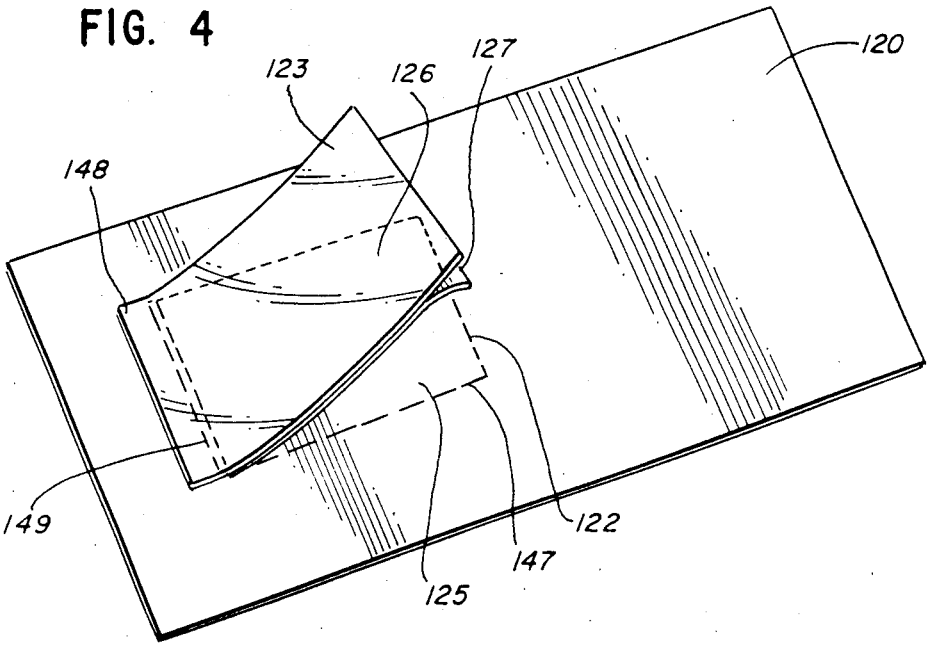
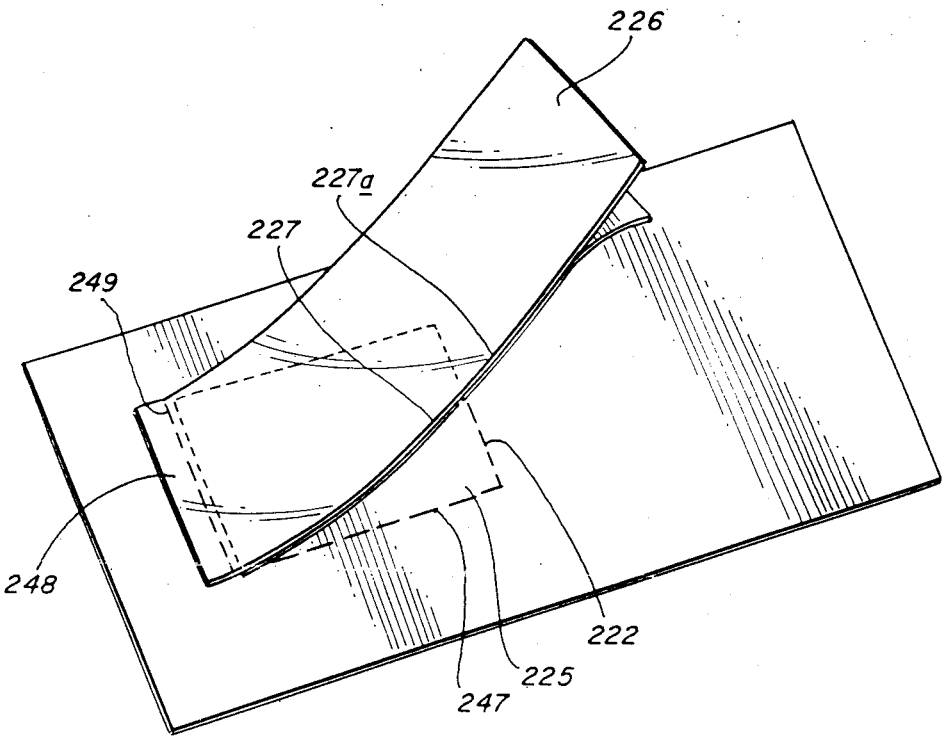
FIG. 5

MAILER WITH I.D. CARD AND METHOD

BACKGROUND AND SUMMARY OF INVENTION

This invention relates to a mailer with I.D. card and method and, more particularly, to a mailer for delivering an I.D. card to a recipient which incorporates laminating means for the recipient to cover the card after the same has been signed.

Mailers are a series of stuffed, sealed envelope assemblies which can be processed through a computer printer for variable information to be applied to both exterior and interior plies. The latter feature has been particularly important in mailers over the last 25 years because it insures that the variable (and sometimes confidential) information is in the proper envelope without the intervention of human agency. Illustrative of the mailers employed in this invention is that shown in co-owned U.S. Pat. No. 4,095,695.

According to the invention, an insert ply carries the I.D. card. Provided as part of the insert is a pressure sensitive adhesive-equipped transparent film having a first portion attached to the insert which is advantageously made of card stock and a second portion of the film is held in face-to-face relation with the card stock by confinement between the front and back plies of the sealed envelope. The second portion of the film is equipped with a release liner over the pressure sensitive adhesive whereby upon removal of the release liner, the film is movable into covering relation with the I.D. card.

Other objects and advantages of the invention may be seen in the details of construction and manufacture set forth in the ensuing specification.

The invention is described in conjunction with the accompanying drawing, in which—

FIG. 1 is an exploded perspective view of one stuffed envelope assembly according to the invention;

FIG. 2 is an exploded sectional view of the envelope assembly of FIG. 1;

FIG. 3 is a schematic side elevational view of apparatus employed in the method of the invention;

FIG. 4 is a perspective view of a modified alternative of the insert according to the invention; and FIG. 5 is a view similar to FIG. 4 but of yet another modification.

DETAILED DESCRIPTION

Laminated I.D. cards have been in use as long as mailers, see, for example, U.S. Pat. No. 3,069,793. No one, however, has developed a mailer equipped with an I.D. card suitable for recipient execution and use. A preferred embodiment of the invention can be seen in FIGS. 1 and 2 wherein the numeral 10 designates generally a stuffed sealed envelope assembly. Here it will be appreciated that the envelope 10 is but one of a connected series of identical envelope assemblies as illustrated in the above mentioned U.S. Pat. No. 4,095,695. There, adjacent assemblies are separated by lines of perforation and normally are delivered by the manufacturer to the user in stacks wherein the mailers are zigzag folded along transverse lines of perforation between adjacent envelope assemblies, i.e., form lengths. The user then steps the connected series of envelope assemblies through a computer printer wherein the variable information is applied after which the connected series is burst into individual envelopes and mailed to the ultimate recipients.

Referring now to FIGS. 1 and 2, the numeral 11 refers to the top ply or envelope front with a portion of the preceding envelope top ply being designated 12 and separated from the top ply 11 by a transverse line of perforation 13. The term "transverse" is employed because the envelope assemblies are advanced along a longitudinal path illustrated by the arrow 14 by virtue of the control punch margins 15, 16. Conventionally, the margins 15, 16 are equipped with line holes as at 17 for engagement with tractor pins, pin belts, etc.

Cooperating with the top or front ply 11 in defining the exterior of the envelope is a bottom or back ply 18 which is also equipped with control punch margins and which is perimetrically united to the top ply by means of glue as at 19.

Positioned between the top and bottom plies 11, 18 are one or more interior or insert plies as at 20 and 21. The important ply insofar as the I.D. card is concerned is the insert ply 20 which is advantageously constructed of card stock, being somewhat stiffer than the remaining plies. For example, the insert ply 21 may be an information ply advising the ultimate recipient on the conditions of use of the I.D. card. The I.D. card is defined as part of the ply 20 by lines of perforation, one of which can be seen at 22 in FIGS. 1 and 2. This is a longitudinally extending line of perforation and the remainder of the card is defined by another longitudinally extending line of perforation and a transverse line of perforation not seen in FIGS. 1 and 2—but which can be appreciated from the showings in FIGS. 4 and 5 relative to alternative modifications. In any event, the I.D. card is separable from the insert ply 20 by breaking the perforation bonds.

Referring again to the embodiment of FIGS. 1 and 2, the numeral 23 designates a transparent film which, on its upper face, is equipped with pressure sensitive adhesive as at 24. This insures that the film 23 is in covering relationship to one face of the I.D. card 25. The remaining portion of the film as at 26 is covered by pressure sensitive adhesive and a release liner 27 which advantageously is constructed of siliconed paper.

In use, the insert ply 25 is removed from the envelope assembly 10 and the I.D. card 25 detached from the insert ply 20. Thereafter, the release liner 27 is removed from the film portion 26 and the portion 26 is rotated through 180° to come into covering relation with the upper face of the I.D. card 25—this after the upper face has been signed by the recipient.

OPERATION

To more fully appreciate the manner of use of the envelope assembly 10, it should be appreciated that after the same has been burst from the connected from the stream or series of assemblies, the control punch margins 15, 16 and the counterparts on the bottom ply 18 are removed. The control punch margins may be adhered together between the top and bottom plies or may be mechanically joined as by clinching. In any event, the control punch margins are removed prior to mailing. For this purpose, aligned longitudinally extending lines of perforation as at 28 and 29 are provided between the control punch margins and the main body of the top and bottom plies.

Upon receipt by the recipient, the mailer is opened by detaching a tear stub generally designated 30 and which extends between the lines of perforation 28, 29 and inwardly positioned superposed lines of perforation 31.

It will be seen that the insert plies 20, 21 are captured within the tear off strip 30 by virtue of extending partway of the width thereof and being adhesively secured as at 32 and 33—see the right hand portion of FIG. 2. Additional details of this part of the construction can be seen in the above mentioned mailer U.S. Pat. No. 4,095,695.

Facilitating the removal of the insert plies once the tear off strip 30 has been removed is the thumb notch defined by a semi-circular line of perforation 34—see particularly the upper right hand portion of FIG. 1.

METHOD OF MANUFACTURE

Reference is now made to FIG. 3 wherein the numeral 35 at the extreme right hand portion designates a roll of continuous web material providing the insert ply 20, i.e., being constructed of card stock material. The insert ply material 20' is unwound and advanced along a longitudinally extending path as at P where laminate segments S are applied thereto in longitudinally spaced relation. The segments S include the film 23, pressure sensitive adhesive 24 and release liner 27.

To provide these in proper position, I start with a roll of laminate as at 36—see the central portion of FIG. 3. This has the three elements superposed, viz., the film 23, the pressure sensitive adhesive 24 and completely overlaying the pressure sensitive adhesive 24 is liner material ultimately providing the liner 27. This laminate 36' is unwound from the roll 36 by means of pull rolls 37 and advanced through a slitter assembly 38 which divides the liner into the portion remaining and the portion which is unneeded. The unneeded liner—in the illustration given in FIGS. 1 and 2—constitutes one-half of the liner material and is removed as at 36'' for rewinding as at 39 for ultimate disposal.

The remaining laminate is advanced onto the surface of a vacuum roll or drum 39 which rotates at a speed faster than the travel of the web laminate 36'. Thus, there is slippage but still retention of the web 36' on the surface of the vacuum roll 39.

The web is transversely severed by means of a knife roll 40 into the discrete segments S and since these segments are no longer restrained by being connected to the main web, they travel with the faster rotating vacuum roll 39 and, in effect, are accelerated to provide a spacing between adjacent segments.

To provide the construction of FIGS. 1 and 2, I employ a further roll of insert ply material 41 which is unwound and provides the insert 21. The superposed webs 20' and 41' are advanced through a chip removal station 42 wherein a transverse chip is removed so as to size the insert plies to fit within the envelope assembly 10.

The now separated insert plies are advanced to a nip 43 where they are joined with webs from rolls 44 and 45 providing the top ply 11' and the bottom ply 18' so as to complete the envelope assembly. A glue applying unit 46 is arranged to apply longitudinally and transversely extending lines of glue to provide the perimetric union 19.

Finally, the now united webs 11' and 18' with the insert plies from the webs 20' and 41' are advanced to a perforator which develops the aligned lines of perforation 31 to provide the tear off strip and also can provide the transverse lines of perforation 13 which separate one form length from those adjacent.

ALTERNATIVE MODIFICATIONS

In FIG. 4, the I.D. card is designated by the numeral 125 and is defined by longitudinally extending lines of perforation as at 122 and transversely extending lines of perforation as illustrated at 147. The film 123 has a first portion 148 adhesively secured—by the pressure sensitive adhesive—to the upper surface of the insert ply 120. The remaining portion of the film 123 is covered by a release liner 127. The first portion 148 is separated from the second portion 126 by a longitudinally extending line of perforation 149.

When the insert ply 120 is removed from the envelope assembly (not shown), the release liner 127 can be detached from the film portion 126 and this portion pivoted down into adhering relationship with the upper face of the I.D. card 125. Then, when the I.D. card 125 is removed from the insert ply 120 by breaking the bonds in the longitudinal and transverse lines of perforation 122, 147, the first and second portions 148, 126 of the film are separated and a covered I.D. card is at hand.

The same procedure is employed with respect to the modification of FIG. 5. There, the insert ply 220 has a part providing the I.D. card 225 defined by lines of perforation 222 and 247. In the FIG. 5 modification there is again a line of perforation 249 separating the first portion 248 from the second portion 226. The difference between the modifications in FIG. 4 and 5 is that the film is approximately twice as long in FIG. 5 so as to cover both sides of the card 225. For this purpose a first liner part 227 is provided for removal so as to cover one face of the card 225 and a second liner 227A is provided for removal so as to make transparent film available to cover the other side of the I.D. card 225.

To facilitate signing, the I.D. 25, 125 or 225 may be equipped with a self-contained, autogenous coating in a localized area. The coating includes both microscopic pressure rupturable capsules containing a chromogenic material, viz., a CB material, and an electron acceptor material (a CF material), alternatively, these can be provided separately with the CF material on the card 125 and the CB material on the confronting face of the liner 127. Additional details of this coating can be found in the co-owned U.S. Pat. No. 4,425,386.

While in the foregoing specification a detailed description of the invention has been set down for the purpose of illustration, many variations in the details hereingiven may be made by those skilled in the art without departing from the spirit and scope of the invention.

I claim:

1. A mailer I.D. product comprising a series of connected stuffed envelope assemblies having continuous top and bottom plies equipped with longitudinally extending control margins and transverse lines of perforation defining individual envelope assemblies, an insert ply within each envelope assembly captured along only one longitudinal side, said insert ply including card stock having longitudinal and transverse lines of perforation therein defining an I.D. card, a pressure sensitive adhesive equipped transparent film having a first portion attached to said card stock, the second portion of said film being held in face-to-face relation with said card stock by confinement between said top and bottom plies, said second portion of said film being equipped with a release liner over said pressure sensitive adhesive whereby upon removal of said release liner said film is movable into covering relation with said I.D. card.

2. The product of claim 1 in which said I.D. card has two faces, said film portion being attached in covering relation to one of said faces, said second portion being sized and constituted to be pivoted into covering relation with the other face of said I.D. card.

3. The product of claim 2 in which said insert ply film and top and bottom plies are equipped with superposed lines of perforation adjacent to and parallel with said one longitudinal edge, said superposed line of weakness in said insert ply defining one edge of said I.D. card.

4. The product of claim 1 in which said first portion is attached to said insert ply adjacent said I.D. card, a line of perforation in said film between said first and second portions.

5. The product of claim 4 in which said second portion is sized to cover one face of said I.D. card.

6. The product of claim 4 in which said second portion is sized to cover both faces of said I.D. card.

7. A mailer I.D. product comprising a stuffed envelope assembly initially having control margins outward of two opposite sides for processing along a longitudinally-extending path, said assembly including front and back envelope plies parametrically united and an insert ply secured along a line of adhesive to one of said front and back plies inwardly adjacent the parametric union associated with one of said sides, superposed longitudinally extending lines of perforation inwardly adjacent said line of weakness in each of said plies providing a tear strip for access to the envelope interior, said insert ply including card stock having longitudinal and transverse lines of perforation therein defining an I.D. card, a pressure sensitive adhesive-equipped transparent film having a first portion attached to said card stock, the second portion of said film being held in face-to-face relation with said card stock by confinement between said front and back plies, said second portion of said card stock being equipped with a release liner over said pressure sensitive adhesive whereby upon removal of said release liner said film is movable into covering relation with said I.D. card.

8. The product of claim 7 in which said I.D. card is equipped with a localized area of autogenous coating having microscopic pressure rupturable capsules containing a chromogenic material and an electron acceptor material.

9. The product of claim 7 in which said first film portion is in covering relation to said I.D. card.

10. The product of claim 7 in which said first film portion is adhered to said card stock adjacent said I.D. card, and a line of perforation between said first and second portions.

11. The product of claim 7 in which said second film portion is equipped with a CB coating, said I.D. card being equipped with a CF coating, said coatings being in face-to-face relationship where said second portion is moved into covering relation with said I.D. card.

* * * * *